United States Patent [19]

Fischer et al.

[11] Patent Number: 4,829,930

[45] Date of Patent: May 16, 1989

[54] PNEUMATIC HORN

[76] Inventors: Jörg Fischer, Nordkanalstrasse 49b, 2000 Hamburg 1; Peter Weimann, Lohmühenweg, 2308 Preetz, both of Fed. Rep. of Germany

[21] Appl. No.: 50,293

[22] PCT Filed: Sep. 8, 1986

[86] PCT No.: PCT/EP86/00516

§ 371 Date: May 5, 1987

§ 102(e) Date: May 5, 1987

[87] PCT Pub. No.: WO87/01850

PCT Pub. Date: Mar. 26, 1987

[30] Foreign Application Priority Data

Sep. 11, 1985 [DE] Fed. Rep. of Germany ..... 3532324

[51] Int. Cl.[4] ..... G10K 9/04

[52] U.S. Cl. ..... 116/142 FP; 116/142 R

[58] Field of Search ..... 116/DIG. 18, Dig. 19, 116/59, 137 R, 142 R, 142 FP, 142 FV; 181/159; 220/208, 209; 340/388-390, 404, 405; 403/307, 335, 336; 446/204, 209, 213, 216, 415, 416

[56] References Cited

U.S. PATENT DOCUMENTS

| | | | |
|---|---|---|---|
| 1,183,676 | 5/1916 | Rogers | 340/388 |
| 1,267,060 | 5/1918 | Dean | 340/388 |
| 1,281,877 | 10/1918 | Teste et al. | 116/142 FP |
| 2,173,951 | 9/1939 | Patterson | 116/142 FP |
| 2,370,939 | 3/1945 | Cooney | 116/142 FP |
| 2,840,032 | 6/1958 | Reeves | 116/132 R |
| 2,918,895 | 12/1959 | Buell | 116/142 FP |
| 3,000,344 | 9/1961 | Ferrell | 116/137 R |
| 4,171,678 | 10/1979 | Palm | 116/142 FP |
| 4,401,049 | 8/1983 | Bevillard | 116/142 FP |
| 4,541,505 | 9/1985 | Beltrame et al. | 181/179 |

FOREIGN PATENT DOCUMENTS

| | | | |
|---|---|---|---|
| 3319140 | 3/1984 | Fed. Rep. of Germany | 181/179 |
| 468378 | 7/1914 | France | 116/142 FP |
| 475735 | 6/1915 | France | 116/142 FP |
| 2532456 | 3/1984 | France | 181/179 |
| 2077019 | 12/1981 | United Kingdom | 116/142 FP |

*Primary Examiner*—William A. Cuchlinski, Jr.
*Assistant Examiner*—W. Morris Worth
*Attorney, Agent, or Firm*—Michael J. Striker

[57] ABSTRACT

A pneumatic horn comprises a housing portion, a base portion connected with the latter, a sound horn, which is held in an opening of the housing portion, and a diaphragm which is fixed between the housing portion and the base portion and rests against an inner pipe connection piece. The housing portion and the base portion each comprise a ring. Each ring is connected with a sheet metal jacket or a sheet metal base, respectively, so as to be fixed against rotation relative to it. The housing portion and the base portion carry diaphragm holding surfaces which securely grip the diaphragm all around in a uniform manner when the housing and base portions are screwed together.

8 Claims, 3 Drawing Sheets

PNEUMATIC HORN

BACKGROUND OF THE INVENTION

The present invention relates to a pneumatic horn. A pneumatic horn of the type under discussion comprises a housing portion, a base portion connected with the latter, a pipe connecting piece, which is arranged inside the housing portion, a sound horn, which is held in an opening of the housing portion and communicates with the pipe connecting piece, a compressed-air duct leading into the housing portion, and a diaphragm which is fixed between the housing portion and the base portion and is adjacent to the pipe connecting piece.

Pneumatic horns of this type are attached externally at the body structures or superstructures of trucks or ships and are operated with high air pressures up to 10 bar and more in order to produce horn sounds which can be heard from far away, wherein the tone pitch depends on the length of the air column formed by the sound horn, the working pressure, the diaphragm thickness and gripping and other parameters. The horn and the housing are constantly exposed to weather conditions and, accordingly, to corrosive stress.

In the pneumatic horn of this type, which is known from DE-OS No. 33 19 140, the outer rim of the sheet material base directly encompasses the outwardly canted circumferential rim of the sheet metal housing and is permanently fixed at the latter by means of inwardly flanged brackets, wherein the diaphragm is gripped between the two sheet metal portions. The tensioning of the diaphragm can be changed by means of stretched bulges of the sheet metal base. However, because of unavoidable manufacturing tolerances and irregularities in the connection of the sheet metal portions, this construction provides no uniform gripping of the diaphragm along the circumference and no satisfactory sound quality. It is also hardly possible to remove the sheet metal base in order to exchange the diaphragm without causing damage.

In addition, an automobile horn is known from DE-GM No. 1967 110, in which the housing portion and the base portion are thick-walled cast pieces which are detachably connected by means of threaded boreholes of the housing portion, which are arranged so as to be spaced along the circumference, and screws which can be screwed into the latter. This construction is not only very heavy and costly to manufacture, but there is also no uniform gripping of the diaphragm along the circumference. In order to achieve an appropriate appearance, costly aftertreatment and chroming of the cast pieces is required, although this will begin to chip off sooner or later, which considerably impairs the appearance of the compressed-air flow.

SUMMARY OF THE INVENTION

It is the object of the present invention to provide a pneumatic horn of the foregoing type, which is inexpensive to manufacture and has a greater resistance to weather, while providing better, easily adjustable tone characteristics and a permanent resistance to weather, and also an appropriate appearance without chroming.

These and other objects of the invention are attained by a pneumatic horn, in which the housing portion comprises a jacket ring which is connected with a sheet metal jacket so as to be fixed with respect to rotation relative to it and comprises an axial circumferential step which is provided with a thread and the base portion comprises a base ring, which is connected with a sheet metal base so as to be fixed with respect to rotation relative to it, which base ring comprises an axial circumferential step and a counter-thread and is screwable with the thread of the jacket ring, the jacket ring and the base ring carrying diaphragm holding surfaces so as to lie axially opposite one another in the installation position, the diaphragm holding surfaces securely gripping the diaphragm all around when the threads are screwed together, the sheet metal jacket, the metal base and the sound horn consisting of weather-resistant metal.

This pneumatic horn combines in itself various advantages. The weather-resistant sheet metal portions can can be simply and inexpensively manufactured by means of pressing or other cold forming so as to be stable enough to withstand the high working pressure without deformation. Since nonrusting sheet steel can be polished very easily, the desired high luster can be achieved without chroming simply by polishing. The solid screwable rings need not consist of corrosion-resistant material, since they are completely covered on the outside by weathering-resistant sheet metal. A secure gripping of the diaphragm so as to be uniform along the entire circumference is brought about in that the rings are screwable, which prevents fluctuations of tone and facilitates the adjustment of the tone. The simple construction comprises only a few individual parts so that the pneumatic horn can be manufactured inexpensively, mounted simply and easily screwed apart in order to exchange the diaphragm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
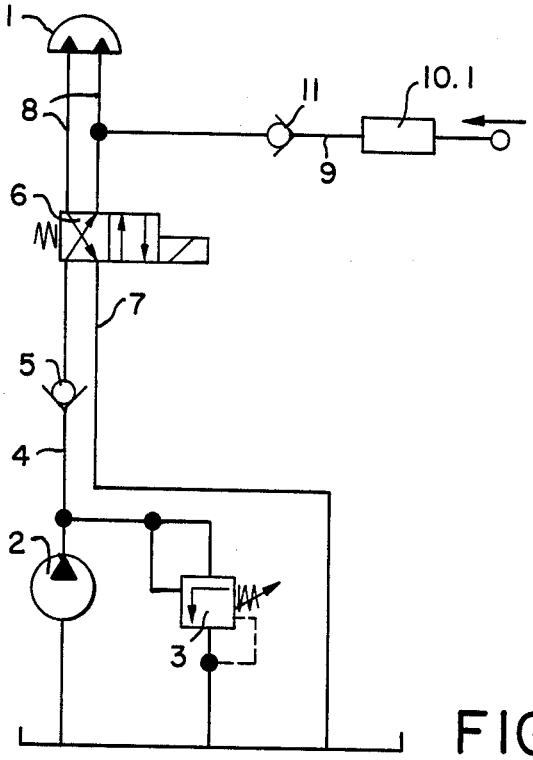
FIG. 1 is a schematic longitudinal section of the pneumatic horn according to the invention.

The pneumatic horn 1 shown in the drawing comprises a housing 2, including a housing portion 4 and a base portion 5, and a sound horn 3 with a straight pipe portion A which has a uniform diameter and is inserted in an opening of the housing portion 4, a conical portion B which adjoins the latter and widens uniformly toward the opening, and an opening portion C which adjoins the conical portion and widens in a trumpet-like manner. The portions A, B and C, which are produced in each instance from nonrusting sheet steel by means of pressing, are connected to each other by means of weld seams extending in the circumferential direction. However, the sound horn 3 can also be bent in one piece from nonrusting sheet steel and can be closed by means of a longitudinal welding seam.

The housing portion 4 comprises a sheet metal jacket 40 of nonrusting sheet steel and a jacket ring 6 which is enclosed by the latter in a clamp fit. The sheet metal jacket 40 comprises a cylindrical circumferential wall 42, a conical portion 41 adjoining the latter, a pipe portion 44 which projects forward axially at its inner edge and comprises an inwardly directed front wall 45 at its front edge and an inner pipe 46 which adjoins the front wall 45 and forms a central opening for the insertion of the pipe portion A of the sound horn 3.

The jacket ring 6 is inserted in the sheet metal jacket 40 in such a way that its outer circumferential surface is tightly enclosed by the inner surface of the circumferential wall 42 and its outer edge is located in the angle formed between the conical portion 41 and the circumferential wall 42. In this position, the jacket ring 6 is clamped with the sheet metal jacket portion 40 so as to be fixed with respect to rotation relative to it by means of an edge web 43 which is radially inwardly flanged on its outer wall.

On its side remote of the conical portion 41, the jacket ring 6 comprises an axial circumferential step 62 which faces inward radially and is adjoined by a radially inwardly projecting ring web 61 forming an outwardly diaphragm holding surface 64 axially facing. An internal thread 63 is cut into the circumferential step 62.

The base portion 5 comprises a sheet metal base 50, which consists of nonrusting sheet steel and comprises a central end wall 55, an outwardly adjoining conical wall 51, an annular wall 52, which extends outward radially from the outer edge of the conical wall 51, and an axial circumferential wall 53 which adjoins the outer edge of the annular wall 52 and corresponds to the circumferential wall 42 of the sheet metal jacket 40. The base ring 7 is tightly enclosed at its outer circumferential surface by the inner surface of the circumferential wall 53 and is connected with the sheet metal jacket 50 so as to be fixed with respect to rotation relative to it in a position axially adjoining the annular wall 52 by means of the flanging of an edge web 54 joined to the circumferential wall 53.

The base ring 7 comprises an axial ring web 71 which carries an axial circumferential step 72 which faces outward radially and comprises an external thread 72 which can be screwed with the internal thread 63 of the jacket ring 6. An axial diaphragm holding surface 74 borders the circumferential step 72. The diaphragm 8, is gripped between this holding surface 74 and the diaphragm holding surface 64 of the jacket ring 6 when the base portion 5 is screwed together with the housing portion 4. The thread engagement of the internal thread 63 with the external thread 73, which thread engagement extends along the entire circumference of the housing 2, ensures a uniform gripping along the entire circumference and an application of force on the outer rim of the diaphragm and, accordingly, a diaphragm sound which is free of fluctuations. In order to exchange the diaphragm 8, the base portion 5 can be rapidly and simply screwed off from the housing portion 4. For this purpose, polygonal tool engagement surfaces, not shown, can also be provided in the sheet metal base 50.

The jacket ring 6 comprises a radial compressed-air duct 12, which is aligned with an opening in the circumferential wall 42 of the sheet metal jacket 40 and comprises an internal thread 13 is arranged in its outer portion for the purpose of screwing in a threaded nipple 14. The latter serves for the connection to a compressed-air feed line 17 to the motor vehicle and, simultaneously, for fastening the pneumatic horn 1 on the motor vehicle, as well as for fixing a conical base part 11, made of nonrusting sheet steel, which is contacted by a rubber washer 15 and a spring washer 16. This economizes on additional through-boreholes of the outside shell of the motor vehicle for guiding through screw bolts and reduces not only the expenditure on fastening means, but also the risk of corrosion.

In the operating state, the base portion 5, comprising the external thread 73 of the base ring 7, is securely screwed with the internal thread 63 of the jacket ring 6, wherein the diaphragm 8 is uniformly gripped all around between the diaphragm holding surfaces 64 and 74. A sealing ring 9, which is slid onto the ring web 71 of the base ring 7, is pressed in between the jacket ring 6 and the base ring 7 in the screwed together state of the housing so as to seal and prevents the penetration of moisture, etc. The sound horn 3 is inserted, with its end portion remote of the opening, in the clamp fit in the inner pipe 46 of the sheet metal jacket 4 and is protected in the area of its opening portion C by a holder 18. In order to produce the horn sound, the compressed air is introduced through the compressed-air duct 12 into the space between the jacket 40, the jacket ring 6, the diaphragm 8 and the pipe connecting piece 10. Since the pipe connecting piece 10 projects forward axially by a small distance a (FIG. 2) over the surface plane of the diaphragm holding surface 64, the diaphragm 8 is tensioned on the rim of the pipe connecting piece 10 in an easily deflected form after the base portion 5 is screwed with the housing portion 4. The diaphragm is lifted from this rim by means of the compressed air and a vibration is brought about, which produces the horn sound and which causes the air column in the sound horn 3 to vibrate along with it and so produce the desired sound pressure. The pipe connection piece 10 can also be formed by means of a correspondingly widened portion of the inner pipe 46, insofar as the latter projects axially over the surface plane of the diaphragm holding surface 64 by a predetermined distance a.

It will be understood that each of the elements described above, or two or more together, may also find a useful application in other types of pneumatic horns differing from the types described above.

While the invention has been illustrated and described as embodied in a pneumatic horn it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a pneumatic horn, comprising a housing portion (4), a base portion (5) connected with the housing portion, a pipe connecting piece (10) which is arranged inside said housing portion (4), a sound horn (3) which is held in an opening of said housing portion (4) and communicates with said pipe connecting piece (10), a compressed-air duct (12) leading into said housing portion (4), and a diaphragm (8) which is fixed between said housing portion (4) and said base portion (5) and rests against said pipe connecting piece (10), the improvement comprising:

(a) said housing portion (4) including a sheet metal jacket (4) and a jacket ring (6) which is connected with said sheet metal jacket (40) so as to be fixed against rotation relative to it, said sheet metal jacket (40) having a radially inwardly bent edge web (43), said jacket ring (6) having a radially inner portion provided with an axial circumferential step (62) having a thread (63) and also provided with a diaphragm holding surface (64), said jacket ring (6) also having a radially outer portion surrounded by said inwardly bent edge web (43) of said sheet metal jacket (40), (b) said base portion (5) including a sheet metal base (50) and a base ring (7) which is connected with said sheet metal base (50) so as to be fixed against rotation relative to it, said sheet metal base (50) having a radially inwardly bent edge web, said base ring (7) having a radially inner portion provided with an axially circumferential step (72) with a counter-thread (73) which is screwable with said thread (63) of said jacket ring (6) and also provided with a diaphragm holding surface (74), so that in an assembled condition said radially inwardly bent edge webs (43 and 44) of said sheet metal jacket (40) and said sheet metal base (50) abut against one another, said diaphragm (8) is securely gripped between said holding surfaces (64 and 74) of said jacket ring (6) and said base ring (7), and said thread (63) and said counter-thread (73) of said jacket ring (6) and said base ring (7) are engaged with one another.

2. Pneumatic horn according to claim 1, wherein said sheet metal jacket (4), said sheet metal base (5) and said sound horn (3) are formed of weather-resistant metal.

3. Pneumatic horn according to claim 1, wherein said sheet metal jacket (40) comprises a conical portion (41) and a central, inwardly directed inner pipe (46) for receiving an end portion of said sound horn (3).

4. Pneumatic horn according to claim 1, wherein said sheet metal jacket (4) comprises a pipe portion (44) for the insertion of said pipe connecting piece (10) supporting said diaphragm (8).

5. Pneumatic horn according to claim 1, wherein said jacket ring (6) includes a compressed-air duct (12) which communicates with an opening of said sheet metal jacket (40).

6. Pneumatic horn according to claim 5, wherein said compressed-air duct (12) comprises an internal thread (13) for a connection with a compressed-air line, said connection being adequate for supporting a given load, and a support carrying said pneumatic horn (1).

7. Pneumatic horn according to claim 1, wherein said sheet metal jacket (40), said sheet metal base (50) and said sound horn (3) are made each of nonrusting sheet metal.

8. Pneumatic horn according to claim 1, wherein said sound horn (3) comprises a pipe portion (A) having a uniform diameter, an adjoining conical portion (B) and an opening portion (C) which adjoins the conical portion and widens in a trumpet-like manner, said portions (A, B, C) being produced by means of pressing and being welded or soldered together.

* * * * *

UNITED STATES PATENT AND TRADEMARK OFFICE

CERTIFICATE OF CORRECTION

PATENT NO. : 4,829,930

DATED : May 16, 1989

INVENTOR(S) : Jörg Fischer, et al.

It is certified that error appears in the above-identified patent and that said Letters Patent is hereby corrected as shown below:

The title page should be deleted to appear as per attached title page.

Figure 2:
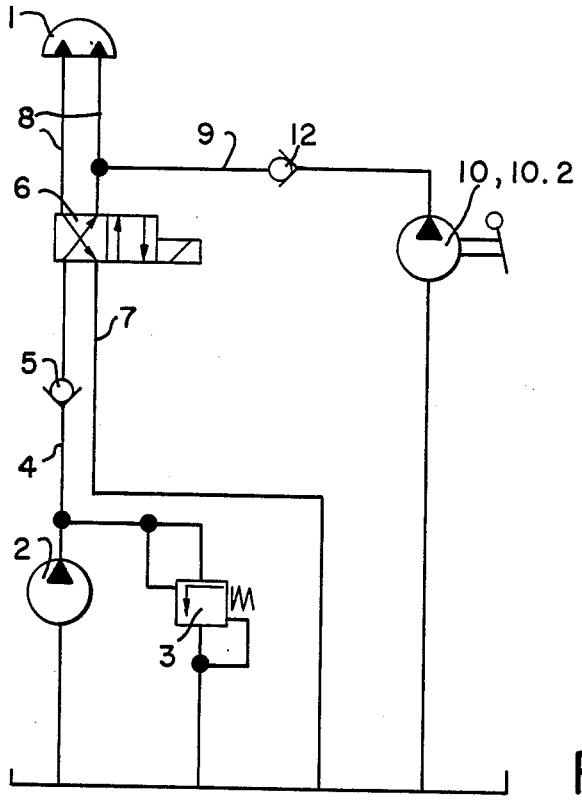
FIG. 2 is an enlarged partial longitudinal section according to FIG. 1.
Figure 3:
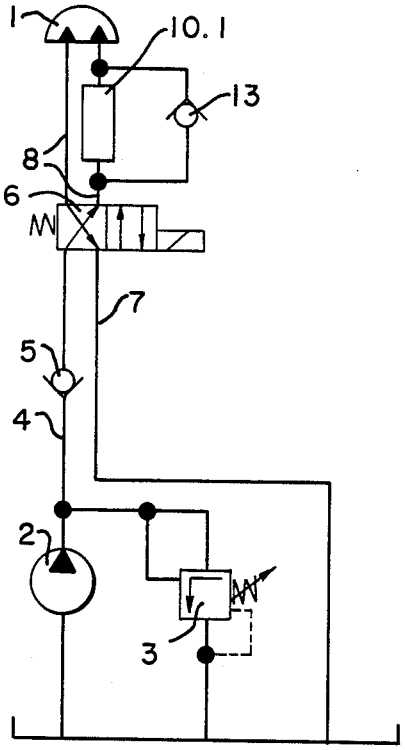
Figure 4A:
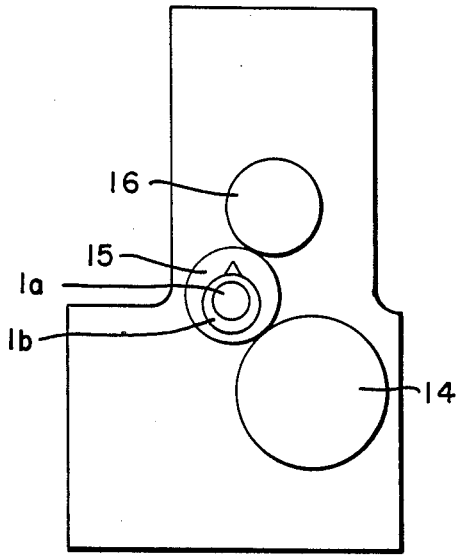
FIG. 4a PRIOR ART.
Figure 4B:
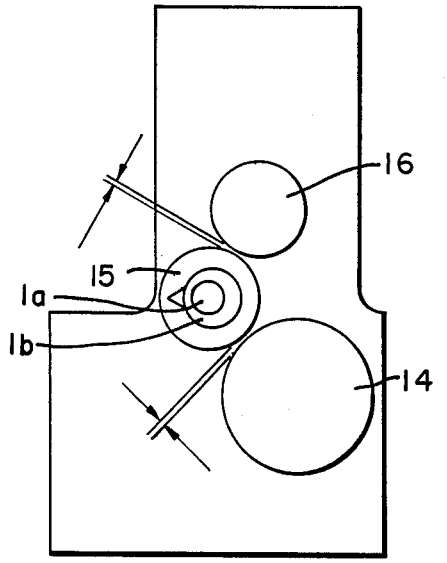
FIG. 4b PRIOR ART.
Figure 1:
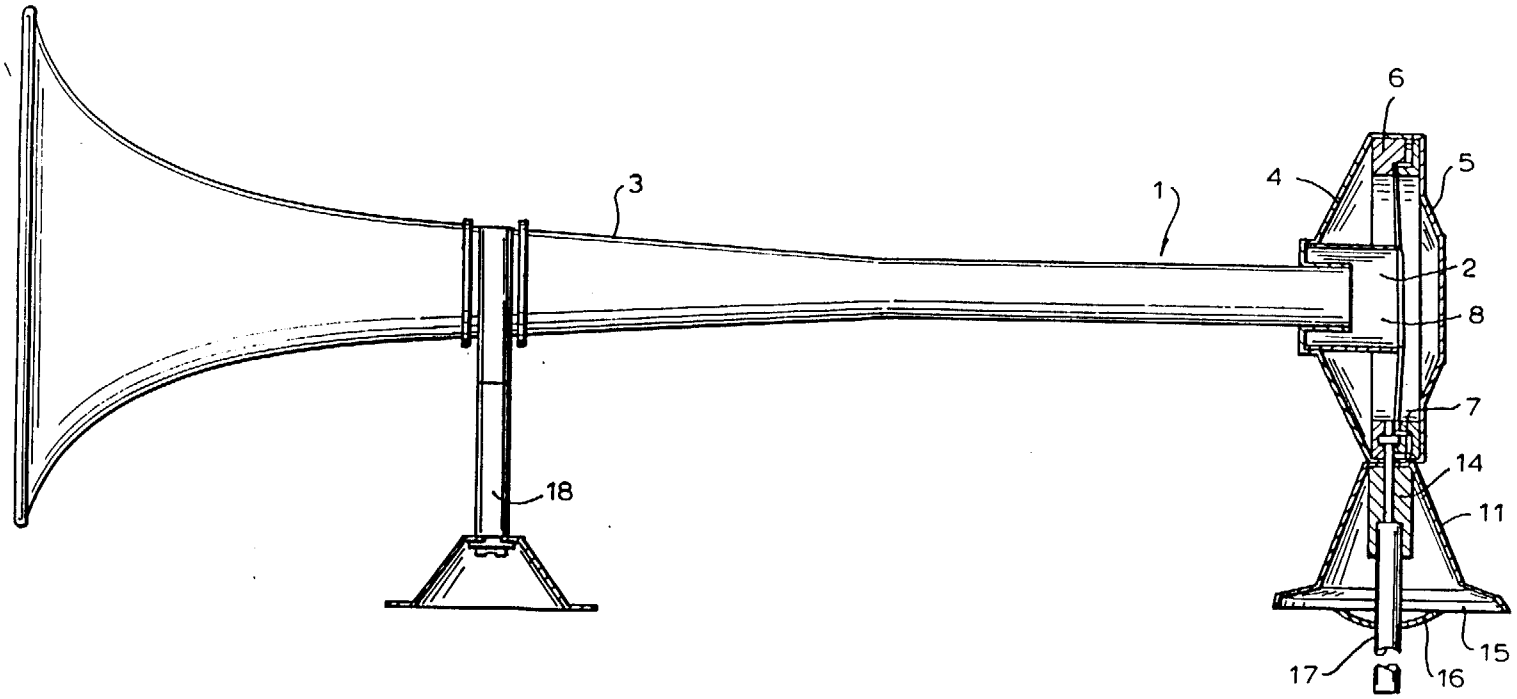
Figure 2:
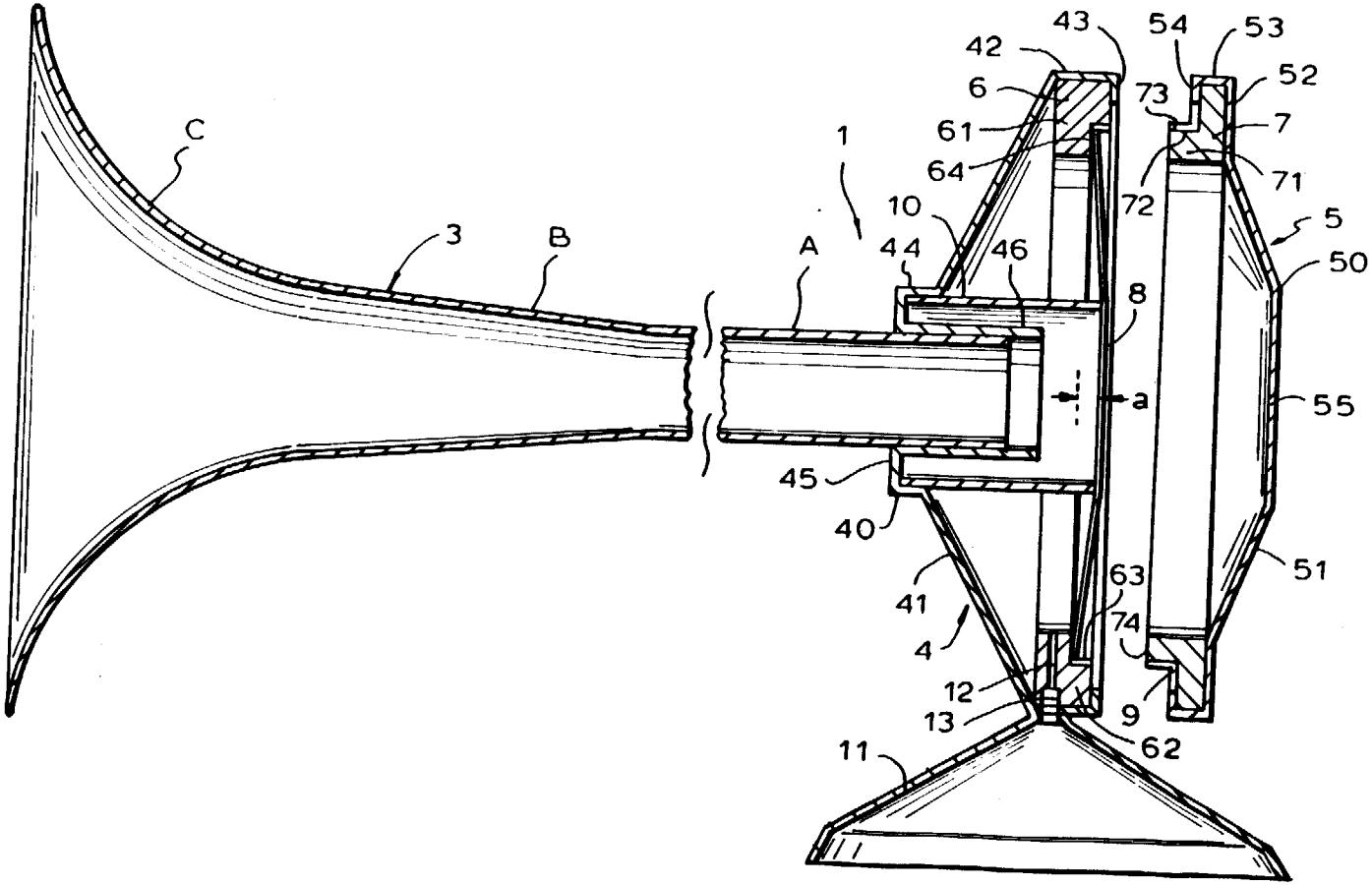

The Sheets of Drawings consisting of Figures 1-3 should be deleted to appear as per attached sheets consisting of Figures 1 and 2.

Signed and Sealed this

Fourteenth Day of November, 1989

*Attest:*

JEFFREY M. SAMUELS

*Attesting Officer*

*Acting Commissioner of Patents and Trademarks*

United States Patent [19]

Fischer et al.

[11] Patent Number: 4,829,930

[45] Date of Patent: May 16, 1989

[54] PNEUMATIC HORN

[76] Inventors: Jörg Fischer, Nordkanalstrasse 49b, 2000 Hamburg 1; Peter Weimann, Lohmühenweg, 2308 Preetz, both of Fed. Rep. of Germany

[21] Appl. No.: 50,293

[22] PCT Filed: Sep. 8, 1986

[86] PCT No.: PCT/EP86/00516

§ 371 Date: May 5, 1987

§ 102(e) Date: May 5, 1987

[87] PCT Pub. No.: WO87/01850

PCT Pub. Date: Mar. 26, 1987

[30] Foreign Application Priority Data

Sep. 11, 1985 [DE] Fed. Rep. of Germany ..... 3532324

[51] Int. Cl.[4] ..... G10K 9/04

[52] U.S. Cl. ..... 116/142 FP; 116/142 R

[58] Field of Search ..... 116/DIG. 18, Dig. 19, 116/59, 137 R, 142 R, 142 FP, 142 FV; 181/159; 220/208, 209; 340/388–390, 404, 405; 403/307, 335, 336; 446/204, 209, 213, 216, 415, 416

[56] References Cited

U.S. PATENT DOCUMENTS

| | | | |
|---|---|---|---|
| 1,183,676 | 5/1916 | Rogers | 340/388 |
| 1,267,060 | 5/1918 | Dean | 340/388 |
| 1,281,877 | 10/1918 | Teste et al. | 116/142 FP |
| 2,173,951 | 9/1939 | Patterson | 116/142 FP |
| 2,370,939 | 3/1945 | Cooney | 116/142 FP |
| 2,840,032 | 6/1958 | Reeves | 116/132 R |
| 2,918,895 | 12/1959 | Buell | 116/142 FP |
| 3,000,344 | 9/1961 | Ferrell | 116/137 R |
| 4,171,678 | 10/1979 | Palm | 116/142 FP |
| 4,401,049 | 8/1983 | Bevillard | 116/142 FP |
| 4,541,505 | 9/1985 | Beltrame et al. | 181/179 |

FOREIGN PATENT DOCUMENTS

| | | | |
|---|---|---|---|
| 3319140 | 3/1984 | Fed. Rep. of Germany | 181/179 |
| 468378 | 7/1914 | France | 116/142 FP |
| 475735 | 6/1915 | France | 116/142 FP |
| 2532456 | 3/1984 | France | 181/179 |
| 2077019 | 12/1981 | United Kingdom | 116/142 FP |

*Primary Examiner*—William A. Cuchlinski, Jr.
*Assistant Examiner*—W. Morris Worth
*Attorney, Agent, or Firm*—Michael J. Striker

[57] ABSTRACT

A pneumatic horn comprises a housing portion, a base portion connected with the latter, a sound horn, which is held in an opening of the housing portion, and a diaphragm which is fixed between the housing portion and the base portion and rests against an inner pipe connection piece. The housing portion and the base portion each comprise a ring. Each ring is connected with a sheet metal jacket or a sheet metal base, respectively, so as to be fixed against rotation relative to it. The housing portion and the base portion carry diaphragm holding surfaces which securely grip the diaphragm all around in a uniform manner when the housing and base portions are screwed together.

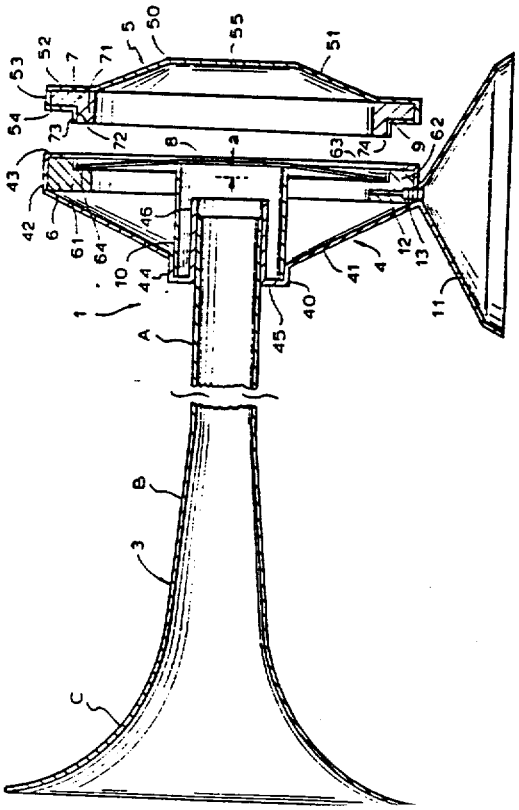

8 Claims, 3 Drawing Sheets